US008395333B2

(12) United States Patent
Beij et al.

(10) Patent No.: US 8,395,333 B2
(45) Date of Patent: Mar. 12, 2013

(54) ELECTRO MAGNETIC BALLAST FOR A GAS DISCHARGE LAMP

(75) Inventors: Marcel Beij, Eindhoven (NL); Rien M. Mertens, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 13/148,772

(22) PCT Filed: Feb. 9, 2010

(86) PCT No.: PCT/IB2010/050576

§ 371 (c)(1), (2), (4) Date: Aug. 10, 2011

(87) PCT Pub. No.: WO2010/092525

PCT Pub. Date: Aug. 19, 2010

(65) Prior Publication Data

US 2011/0316434 A1 Dec. 29, 2011

(30) Foreign Application Priority Data

Feb. 13, 2009 (EP) ..... 09152745

(51) Int. Cl.
*H05B 41/00* (2006.01)

(52) U.S. Cl. ..... 315/352; 315/208; 315/307; 315/341; 315/344

(58) Field of Classification Search ..... 315/200 R, 315/208, 291, 307, 326, 341, 344, 349, 352
See application file for complete search history.

(56) References Cited

U.S. PATENT DOCUMENTS

| | | | | |
|---|---|---|---|---|
| 6,362,575 | B1 * | 3/2002 | Chang et al. | 315/224 |
| 6,982,528 | B2 * | 1/2006 | Cottongim et al. | 315/309 |
| 7,129,650 | B2 * | 10/2006 | Komatsu et al. | 315/291 |
| 7,417,382 | B2 * | 8/2008 | Lin | 315/225 |
| 7,615,937 | B2 * | 11/2009 | Mishima | 315/291 |
| 2003/0031037 | A1 * | 2/2003 | Piaskowski | 363/125 |
| 2004/0239263 | A1 * | 12/2004 | Vakil et al. | 315/291 |
| 2007/0188111 | A1 * | 8/2007 | Taipale | 315/291 |
| 2010/0201407 | A1 * | 8/2010 | Falter et al. | 327/110 |

FOREIGN PATENT DOCUMENTS

| | | | |
|---|---|---|---|
| DE | 19841227 | C1 | 3/2000 |
| GB | 2316245 | A | 2/1998 |
| WO | 03103344 | A1 | 12/2003 |
| WO | 2009101552 | A1 | 8/2009 |

* cited by examiner

*Primary Examiner* — Jason M Crawford

(57) ABSTRACT

An electro magnetic ballast (110) for a gas discharge lamp (2) comprises: input terminals (3), for receiving a mains voltage; lamp connector terminals (4), for receiving a lamp; a controllable semiconductor switch (26) coupled in parallel to the lamp connector terminals; a current sensor (127) connected in series with the controllable switch (26); and a control circuit (28) for controlling the controllable switch (26) and responsive to the current sensor (127). When operating in a normal mode, the control circuit (28) is responsive to a current sense signal received from the current sensor to switch the controllable switch (26) ON if said current sense signal indicates a current flowing in the controllable switch (26) and to switch the controllable switch (26) OFF if said current sense signal indicates that no current is flowing in the controllable switch (26).

5 Claims, 3 Drawing Sheets

ELECTRO MAGNETIC BALLAST FOR A GAS DISCHARGE LAMP

FIELD OF THE INVENTION

The present invention relates in general to the switching of discharge lamps.

BACKGROUND OF THE INVENTION

It is generally known that gas discharge lamps, for example the well-known TL-lamps, are driven by an electro magnetic ballast (EM ballast). FIG. 1 is a schematic block diagram, illustrating such conventional EM ballast 1 for a lamp 2. The ballast 1 of this example comprises an inductor L and a capacitor C in series with the lamp 2 to be driven, and a mechanical switch S in parallel to the lamp, typically of a bimetal design. The ballast 1 further has input terminals 3 for connection to mains, typically 230 V 50 Hz in Europe. Lamp connector terminals are indicated at 4, lamp electrodes are indicated at 5. In the case of such conventional ballast, the lamp can only be switched ON and OFF by switching the mains.

In a more sophisticated design, the mechanical switch is replaced by a controllable semiconductor switch, operated by an intelligent control device such as for instance a micro controller. FIG. 2 is a schematic block diagram, illustrating such ballast 10. Compared to the example of FIG. 1, the mechanical switch S has been replaced by an electronic switching circuit 20. This electronic switching circuit 20 comprises a full-wave rectifier 21 (shown as a four-diode bridge) having input terminals 22, 23 connected in parallel to the lamp 2, and having a positive output terminal 24 and a negative output terminal 25. The electronic switching circuit 20 further comprises a semiconductor switch 26, shown as a MOSFET, connected between the positive and negative terminals 24, 25.

The electronic switching circuit 20 further comprises a control device 28, having a control output 28*a* connected to the control terminal of the switch 26. The control device 28 may derive its power from the terminals 24, 25, or may derive its power from an external circuit (not shown). The control device 28 may be responsive to external command signals, transmitted over an external circuit (not shown), via a wired or wireless link, e.g. RF.

Assume that the mains power is switched on while the switch 26 is OFF, i.e. non-conductive. The voltage from the mains is insufficient to start the lamp. Starting the lamp is done by the controller 28 in two steps. The first step involves switching the switch 26 ON, i.e. generating a control signal Sc for the switch 26 such as to render the switch 26 conductive. Now, an AC current will flow through the inductor L and the lamp electrodes 5, heating the lamp electrodes 5. In a second step, the controller 28 switches the switch 26 OFF again, i.e. it generates its control signal Sc for the switch 26 such as to render the switch 26 non-conductive. As a result of this interruption, the inductor L develops a high voltage causing breakdown and ignition of the lamp, so that lamp current flows between the electrodes 5 within the lamp.

The magnitude of the ignition voltage induced by the inductor L depends on the amount of energy E(L) stored in the inductor at the moment of interrupting the current circuit, which can be expressed as $E(L)=0.5\cdot L\cdot I^2$.

SUMMARY OF THE INVENTION

A problem is associated with the fact that the voltage induced by the inductor L is also applied to the switch 26, which is after all connected in parallel to the lamp 2. Normally, the lamp ignites before the induced voltage reaches its maximum, but it may be that the lamp does not ignite immediately. In such case, the maximum value of the induced voltage will be applied to the switch, that is not capable to resist this voltage and will conduct a current in avalanche mode. Such current may cause the switch to be destroyed. In order to prevent this, the controller 28 may be programmed to set the timing of the interruption of the preheat current so that it does not coincide with the maximum current: a suitable timing is for instance 86% of the current period. In that case, for an exemplary situation of a 70 W lamp, where the coil has an inductance of 600 mH while the momentary coil current is about 0.75 A, the energy E(L) stored in the inductor is about 170 mJ. For normal switches, the amount of avalanche energy they can resist is about 350 mJ.

However, it is also possible a user to switch off the lamp 2 by switching the mains. Or, it may be that the lamp fails and stops working. In both cases, the above scenario also takes place, with the difference that the timing with respect to the current phase is now random so it may coincide with the maximum lamp current and thus may result in a very high voltage peak over the switch. In the example mentioned above, the maximum lamp current may be about 1.6 A and the energy applied to the switch is about 770 mJ.

An object of the present invention is to provide a ballast with an electronic switching circuit wherein the above-mentioned problems are overcome, particularly, wherein the electronic switch is protected against high induction voltage pulses.

According to the present invention, the controller 28 is adapted to monitor whether a current flows through the switch while it is OFF, and if so, to switch the switch to its ON condition. Now the current, which continues to flow, does not harm the switch any more, and the switch may dissipate some of the energy on the basis of its small resistance RDSon.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
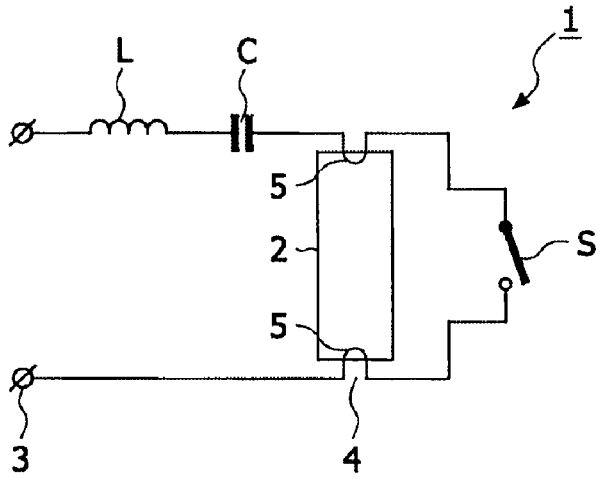
FIG. 1 (Prior Art)
FIG. 1 is a schematic block diagram illustrating a conventional EM ballast with a mechanical switch.
Figure 2:
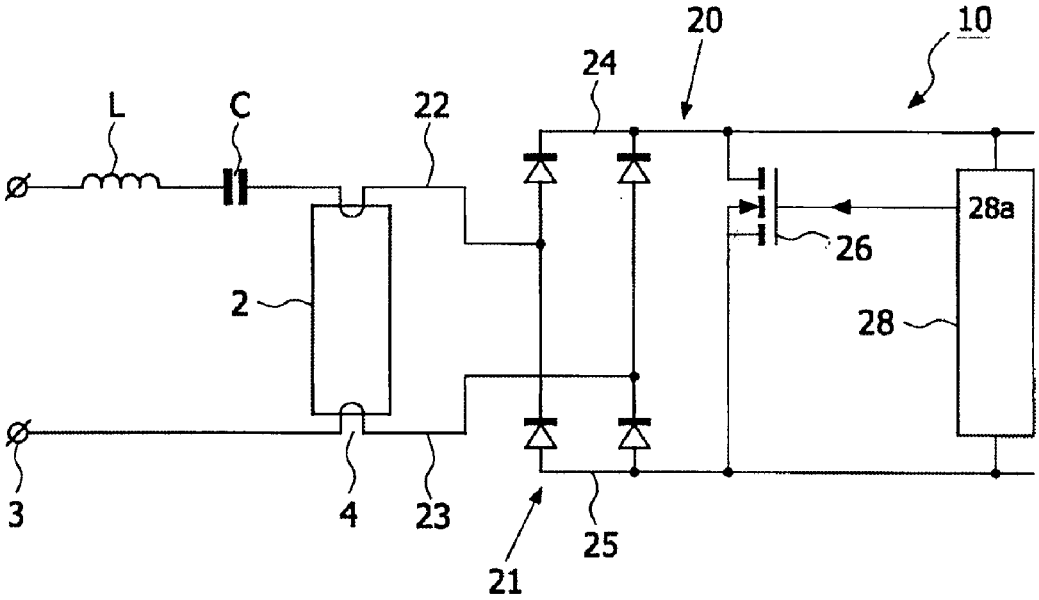
FIG. 2 (Prior Art)
FIG. 2 is a schematic block diagram illustrating an EM ballast with a controllable semiconductor switch.
Figure 3:
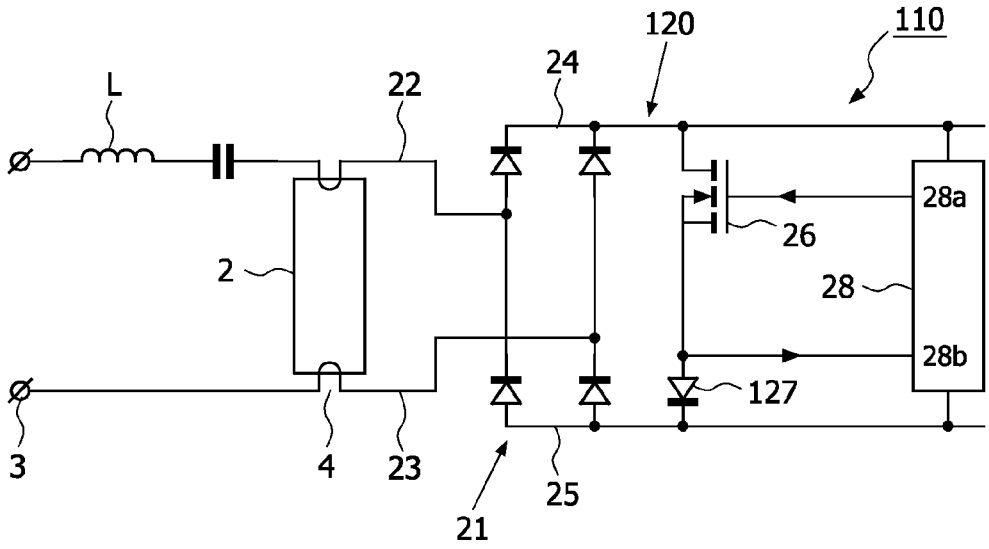
FIG. 3 is a schematic block diagram illustrating an EM ballast with a controllable semiconductor switch according to the present invention.

FIG. 3 is a block diagram schematically illustrating an embodiment of a ballast according to the present invention, generally indicated by the reference numeral 110, having an electronic switching circuit 120, which comprises all elements of the circuit 20 as described above, plus additionally a current sensor 127 in series with the switch 26. The current sensor may be implemented as a small resistance, but it is in this embodiment shown as a diode. The controller 28 has a sense input 28*b* for receiving the output signal from the current sensor 127.

Figure 4:
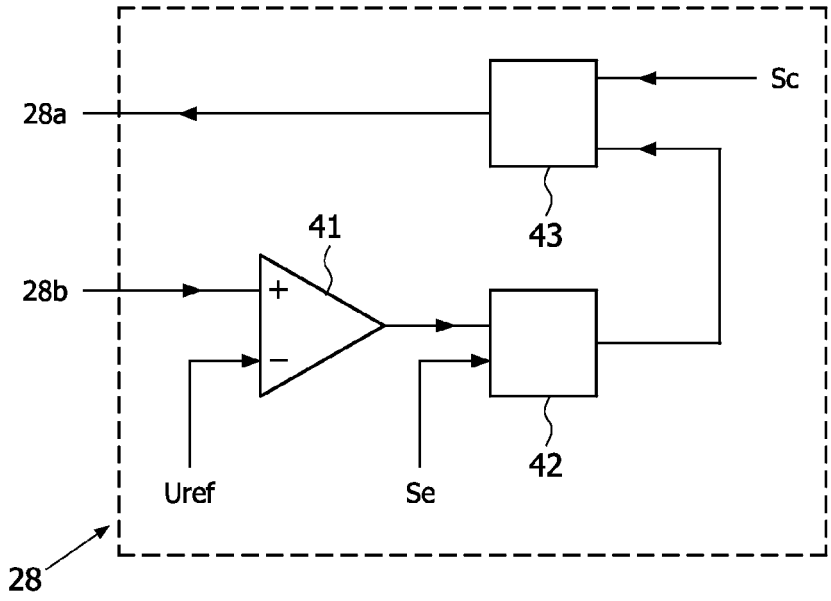
FIG. 4 is a block diagram schematically illustrating a hardware implementation of the present invention.

FIG. 4 is a block diagram schematically illustrating a hardware implementation of the present invention. The controller 28 comprises a comparator 41, having its positive input connected to the sense input 28*b* and receiving a reference voltage Uref at its negative input. The controller 28 further comprises an AND gate 42, having one input connected to the output of the comparator 41, and receiving an enable signal Se at another input. The controller 28 further comprises an OR gate 43, having one input connected to the output of the AND gate 42, and receiving a control signal Sc at another input.

During the stages of preheating and ignition, the enable signal Se is LOW, and the output signal from the AND gate 42 is LOW. Thus, the switching state of the switch 26 is only determined by the control signal Sc, which is HIGH for closing the switch 26 to generate the preheat current and which is switched to LOW for opening the switch to trigger ignition.

Then, the controller 28 enters a normal operation mode, during which the lamp is burning normally. In this mode, the enable signal Se is HIGH and the control signal Sc is LOW. As long as no current is flowing through the switch 26, the output signal from the AND gate 42 remains LOW and the switch remains open. As soon as a current in the switch 26 (which must be an avalanche current because the switch is open) reaches a sufficient magnitude, the comparator 41 outputs a HIGH signal, causing the AND gate 42 to output a HIGH signal, which in turn causes the OR gate 43 to output a HIGH signal so that the switch 26 is closed. Note that the switch 26 is opened automatically when the current in the switch has extinguished.

Figure 5:
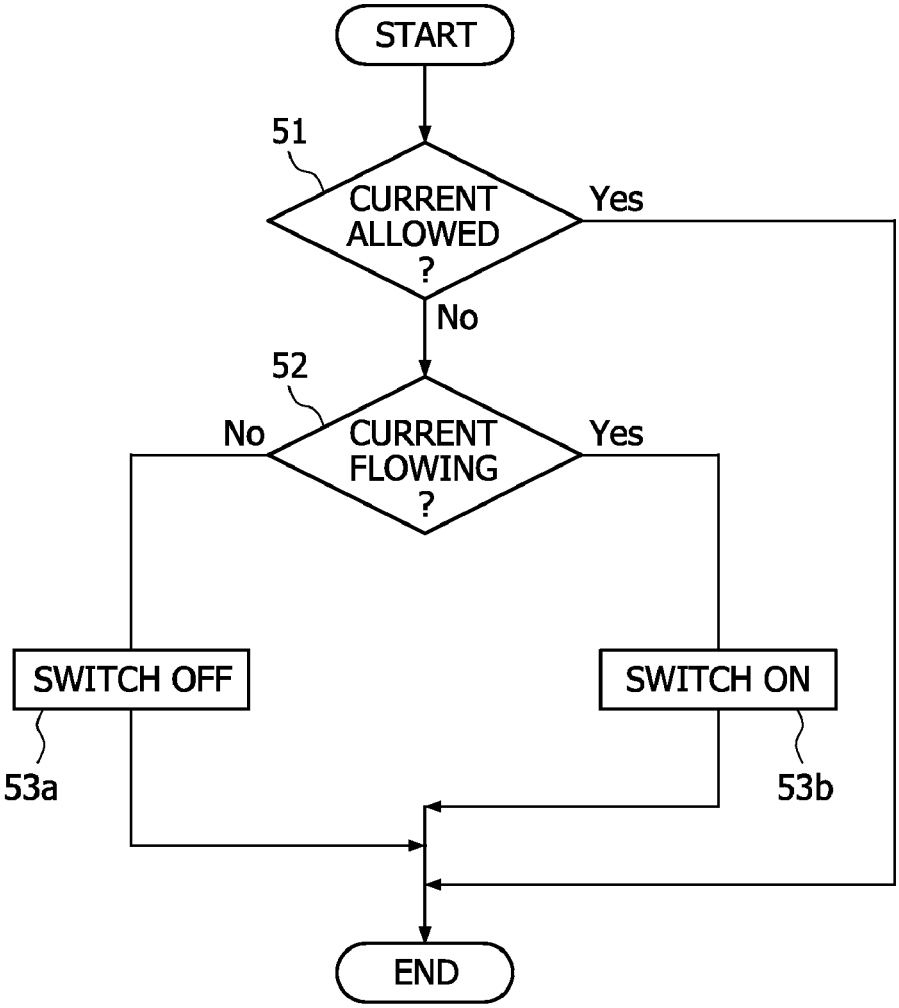
FIG. 5 is a flow diagram schematically illustrating a software implementation of the present invention.

FIG. 5 is a flow diagram schematically illustrating a software implementation of the present invention.

In step 51, the controller 28 checks whether it is operating in a mode in which current through the switch is allowed, such as the preheat phase or ignition. If yes, no further action needs to be taken.

In step 52, the controller 28 checks whether any current is flowing through the switch. If no, the controller 28 sets or maintains a control signal for the switch 26 such as to turn or maintain the switch OFF in step 53*a*. If yes, the controller 28 sets or maintains a control signal for the switch 26 such as to turn or maintain the switch ON in step 53*b*.

It is noted that in the above embodiments the rectifier 21 allows the use of relatively cheap MOSFETs, which should be operated to conduct current in one direction only. Instead, it is in principle possible to another type of controllable switch, capable to be operated with current in two directions, in which case the rectifier can be omitted.

Summarizing, the present invention provides an electro magnetic ballast 110 for a gas discharge lamp 2, which comprises:

input terminals 3, for receiving a mains voltage;

lamp connector terminals 4, for receiving a lamp;

a controllable semiconductor switch 26 coupled in parallel to the lamp connector terminals;

a current sensor 127 connected in series with the controllable switch 26;

and a control circuit 28 for controlling the controllable switch 26 and responsive to the current sensor 127.

When operating in a normal mode, the control circuit 28 is responsive to a current sense signal received from the current sensor to switch the controllable switch 26 ON if said current sense signal indicates a current flowing in the controllable switch 26 and to switch the controllable switch 26 OFF if said current sense signal indicates that no current is flowing in the controllable switch 26.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims. For instance, the capacitor C may be absent. Further, the inventive gist of the present invention can also be applied to protect other semiconductor switches against avalanche currents, i.e. even in other applications not being a lamp ballast application.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. An electro magnetic ballast (110) for a gas discharge lamp (2), comprising:

input terminals (3), for receiving a mains voltage;

lamp connector terminals (4), for receiving a lamp;

a controllable semiconductor switch (26) coupled in parallel to the lamp connector terminals;

a current sensor (127) connected in series with the controllable switch (26);

and a control circuit (28) for controlling the controllable switch (26) and responsive to the current sensor (127);

wherein, if the controllable switch is OFF due to (1) a signal from the control circuit, (2) mains voltage is not received or (3) when in an operating mode the lamp fails, and the control circuit (28) receives a current sense signal from the current sensor indicating current is still flowing to the controllable switch, the control circuit (28) switches the controllable switch (26) ON and switches the controllable switch (26) OFF if said current sense signal indicates that no current is flowing in the controllable switch (26).

2. An electro magnetic ballast (11 for a gas discharge lamp (2), comprising:

input terminals (3), for receiving a mains voltage;

lamp connector terminals (4), for receiving a lamp;

a controllable semiconductor switch (26) coupled in parallel to the lamp connector terminals;

a current sensor (127) connected in series with the controllable switch (26);

and a control circuit (28) for controlling the controllable switch (26) and responsive to the current sensor (127);

wherein when operating in a normal mode, the control circuit (28) is responsive to a current sense signal received from the current sensor to switch the controllable switch (26) ON if said current sense signal indicates a current flowing in the controllable switch (26) and to switch the controllable switch (26) OFF if said current sense signal indicates that no current is flowing in the controllable switch (26);

an impedance connected in series with the lamp connector terminals, the impedance comprising at least an inductor (L) and preferably comprising a series arrangement of a capacitor (C) and an inductor (L);

an electronic switching circuit (120) having input terminals (22, 23) connected in parallel to the lamp connector terminals;

wherein the electronic switching circuit (120) comprises:

the controllable switch (26) coupled in parallel to the input terminals (22, 23);

and the control circuit (28) having an output (28*a*) coupled to a control input of the controllable switch (26) and having a sense input (28*b*) coupled to an output of the current sensor (127);

wherein the control circuit (28) is capable of operating in a preheat mode in which it generates a first control signal for the controllable switch (26) such as to render the controllable switch (26) conductive;

wherein the control circuit (28) is capable of operating in an ignition mode after said preheat mode in which it generates a second control signal for the controllable switch (26) such as to render the controllable switch (26) non-conductive;

and wherein the control circuit (28) is capable of operating in a normal mode in which a lamp current is flowing and the control circuit (28) normally maintains its second control signal for the controllable switch (26) such as to keep the controllable switch (26) non-conductive;

and wherein the control circuit (28), while operating in said normal mode, is responsive to the current sense signal received at its sense input (28*b*) to generate its first control signal for the controllable switch (26) if said current sense signal indicates a current flowing in the controllable switch (26) and to generate its second control signal for the controllable switch (26) if said current sense signal indicates that no current is flowing in the controllable switch (26).

3. Electro magnetic ballast according to claim 2, wherein the electronic switching circuit comprises a rectifier (21) connected to the input terminals (22, 23) and having a positive output terminal (24) and a negative output terminal (25);

wherein the series arrangement of said controllable switch (26) and said current sensor (127) is connected between said positive output terminal (24) and said negative output terminal (25).

4. Control circuit (28) for controlling a controllable semiconductor switch (26), having an input (28*b*) for receiving a current sense signal representing the current through the semiconductor switch (26), and having an output (28*a*) for providing a control signal for the semiconductor switch (26);

wherein the control circuit (28) is responsive to the current sense signal to generate its control signal such that said controllable switch (26) is turned or maintained ON if said current sense signal indicates a high induction voltage pulse causing an avalanche current flowing in the controllable switch (26) and to generate its control signal such that said controllable switch (26) is turned or maintained OFF if said current sense signal indicates that no current is flowing in the controllable switch (26).

5. Method for protecting a controllable semiconductor switch (26) against avalanche currents, the method comprising the steps of:

while the semiconductor switch (26) is OFF, sensing the current through the semiconductor switch (26) in the forward direction;

if the sensed current is above a predetermined (avalanche current) threshold, generating a control signal for the semiconductor switch (26) such as to turn the semiconductor switch (26) ON.

* * * * *